United States Patent [19]

Fox

[11] Patent Number: 4,570,521

[45] Date of Patent: Feb. 18, 1986

[54] ELECTRONIC MUSICAL INSTRUMENT WITH STRING-SIMULATING SWITCHES

[76] Inventor: Jeffrey Fox, 4105 Madison, Culver City, Calif. 90230

[21] Appl. No.: 595,294

[22] Filed: Mar. 30, 1984

[51] Int. Cl.[4] ..... G10H 1/34; G10H 5/00

[52] U.S. Cl. ..... 84/1.01; 84/DIG. 30; 200/5 A

[58] Field of Search ..... 84/1.01, 1.16, DIG. 30; 200/5 A, 86 R; 340/365 R, 365 C

[56] References Cited

U.S. PATENT DOCUMENTS

| | | | |
|---|---|---|---|
| Re. 31,019 | 8/1982 | Evangelista | 84/1.16 |
| 3,340,343 | 9/1967 | Woll | 84/1.13 |
| 3,555,166 | 1/1971 | Gasser | 84/1.01 |
| 3,662,641 | 5/1972 | Allen | 84/1.01 |
| 3,830,991 | 8/1974 | Durocher | 200/86 R |
| 4,035,645 | 4/1978 | Ryon | 84/1.01 |
| 4,078,464 | 3/1978 | Sugiyama | 84/1.01 |
| 4,126,070 | 11/1978 | Hill | 84/1.01 |
| 4,235,141 | 11/1980 | Eventoff | 84/1.01 |
| 4,339,979 | 7/1982 | Norman | 84/1.23 |
| 4,352,310 | 10/1982 | Orlandoni | 84/1.01 |
| 4,455,465 | 6/1984 | Habeger | 200/86 R |
| 4,497,989 | 2/1985 | Miller | 200/86 R |

*Primary Examiner*—S. J. Witkowski

*Attorney, Agent, or Firm*—Klein & Szekeres

[57] ABSTRACT

An electronic musical instrument includes a fingerboard having a plurality of switches which are player-actuated to produce musical tones through electronic tone-generating means. The fingerboard, which is on an elongate neck, has, underneath its exterior surface, one or more rows of cavities, each cavity containing a pressure-actuable membrane switch. The surface of the fingerboard above each cavity is flexible, and each switch is closeable in response to a localized deformation of the flexible fingerboard area above the cavity in which the switch is located. A continuous flexible bar is situated on the fingerboard above each row of cavity enclosed switches. Pressure applied to the bar by a player at a location above a selected cavity results in a localized deformation of both the bar and the underlying fingerboard, thereby transmitting sufficient pressure to the switch in the selected cavity to close it. The deformation is sufficiently localized to result in the closing of only one selected switch. The resilience of the bar and the fingerboard causes the switch to reopen upon release of the pressure on the bar.

20 Claims, 7 Drawing Figures

ELECTRONIC MUSICAL INSTRUMENT WITH STRING-SIMULATING SWITCHES

BACKGROUND OF THE INVENTION

This invention relates to the field of electronic musical instruments. More specifically, the present invention relates to an electronic musical instrument of the type which simulates a conventional stringed instrument, such as, for example, a guitar.

Electronic musical instruments have enjoyed a marked increase in popularity in recent years. Often called "synthesizers", such instruments employ electronic tone-generating means to produce musical tones. Notes and chords are produced when the player actuates predetermined combinations of tone-generators, each producing a selected frequency, through the closing of appropriate switches on the instrument.

Usually, electronic instruments are designed to simulate conventional accoustic instruments, both in manner or technique of playing, and in the sound produced. One increasingly popular type of electronic instrument is designed to simulate a guitar. Examples of such electronic guitar analogs are found in the following U.S. Pat. Nos. 3,340,343-Woll; 3,555,166-Gasser; 3,662,641-Allen et al., 4,339,979-Norman; and Re 31,019-Evangelista.

Each of the above-noted patents discloses an instrument having a guitar-like body and a neck, or fretboard. The patent to Allen et al. discloses a device which includes strings on the body of the instrument and capacitive, touch-sensitive switches on the neck which are manipulated in conjunction with the strings to create musical tones. In the remaining patents, the disclosed devices use electrical switches only, in a variety of forms, to replace the strings totally.

In playing the guitar, chord changes are frequently accomplished by sliding the fingers up and down the neck between the frets. Note progressions also may sometimes be played in this manner. The prior art electronic guitar analogs, as exemplified in the above-noted patents, are not conducive to this type of playing because of their use of separate, discrete switch actuation elements at each note-playing position along the guitar neck. Thus, the ability of the player to slide the chord-forming fingers along the neck without lifting them therefrom is impaired. Even if the player can overcome this difficulty, or accommodate his or her technique to the structure of the switches, the transition from one note or chord to the next would tend to be more abrupt than would be the case with a continuous string. The resulting difference in musical quality, while possibly subtle, might be noticeable to the discerning listener.

Thus, a need has been felt for an electronic musical instrument having switches in the neck which simulate, as closely as possible, the "feel" of actual strings, so that the player does not have to alter, significantly, his or her standard technique in forming and changing chords and notes. The string-like "feel", moreover, should be accompanied by the capacity to allow smooth tonal transitions as chords or notes are changed when the player's fingers slide up and down the neck, as would be the case with actual strings.

SUMMARY OF THE INVENTION

In a broad sense, the present invention is a player-actuable switching mechanism for an electronic musical instrument comprising a body and a neck, wherein the switching mechanism includes a plurality of tone-generator actuation switches in the neck of the instrument, configured and arranged to simulate the "feel" of a stringed instrument, such as a guitar. More specifically, the invention comprises a plurality of pressure-actuated membrane switches in positions on the instrument's neck corresponding to preselected notes which would be played, on a stringed instrument, at similar positions on the strings; and a plurality of elongate, continuous switch actuation bars extending longitudinally along the neck over the switches.

What is thus provided is a grid of switches, with a longitudinal row of switches corresponding to each string, and a transverse row of switches at each position between the frets. The switch actuation bars, although presenting longitudinally continuous actuation surfaces along the neck, are sufficiently flexible so that pressure on a bar at a selected fretted position actuates only a single switch.

With this arrangement, the player's fingers can actuate individual switches in the instrument's neck by depressing the longitudinal bars at locations between the frets. Moreover, the fingers can slide up and down over the neck to different fret positions without being lifted off of the surface of the string-like bars, thereby providing smooth tonal transitions as chords or notes are changed, as would be the case with actual strings.

Thus, a close approximation of the "feel" of a stringed instrument can be achieved, with little alteration of standard fretboard technique. This characteristic allows a musician who is experienced on such an instrument (such as the guitar), but not with a synthesizer, to adapt readily to playing a synthesizer (by means of this electronic instrument) with little or no training. Moreover, the switch arrangement of the present invention allows chords and notes to be both formed and played with the one hand actuating the bars on the neck. The other hand is thus freed to manipulate other mechanisms (such as, for example, keys) on the body of the instrument to produce notes beyond the range of notes played on the neck. In this manner, the instrument offers the ability to provide an extended musical range over what would be available if both hands were required to play the notes corresponding to the switches in the neck.

As will be appreciated more fully from the detailed description which follows, the present invention thus provides an electronic musical instrument which offers the "feel" and fretboard technique of a conventional stringed instrument, while also offering the extended tonal range and versatility of an electronic music synthesizer.

As will be further appreciated, while the playing technique (at least on the fretboard) can closely simulate that of a particular instrument, the actual sounds and tones produced can be made to simulate virtually any musical instrument, depending upon the tone-producing circuitry in the synthesizer.

DETAILED DESCRIPTION OF A PREFERRED EMBODIMENT

Figure 1:
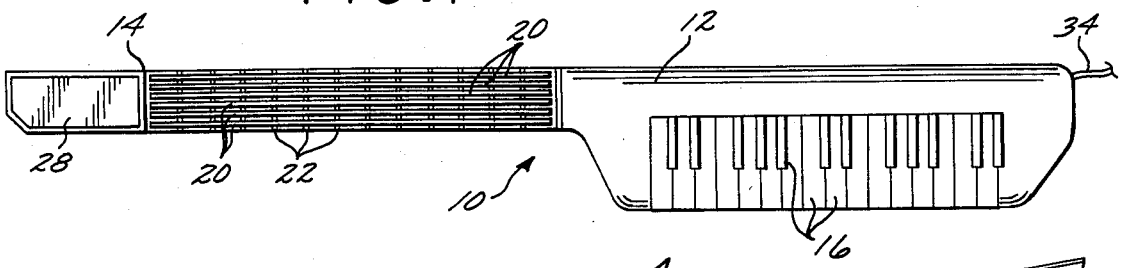
FIG. 1 is a top plan view of an electronic musical instrument, in accordance with a preferred embodiment of the invention.

Referring first to FIG. 1, an electronic musical instrument, in accordance with a preferred embodiment of the invention, is illustrated and designated by the numeral 10. The instrument 10 comprises a main body portion 12, from which extends an elongate member or neck 14. The body portion 12 may, preferably, include a keyboard having a plurality of keys 16, of the type used in accordians and the like. The keys 16 can be used to actuate electronic tone-generating mechanisms, as will be described below.

Figure 2:
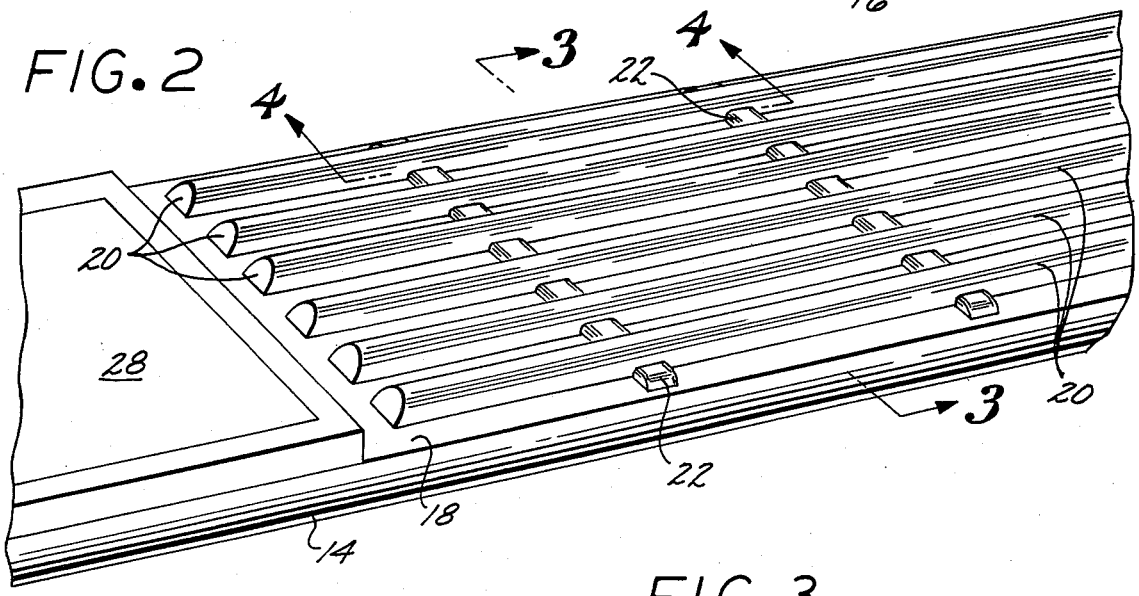
FIG. 2 is a detailed perspective view of a portion of the neck of the instrument shown in FIG. 1.
Figure 3:
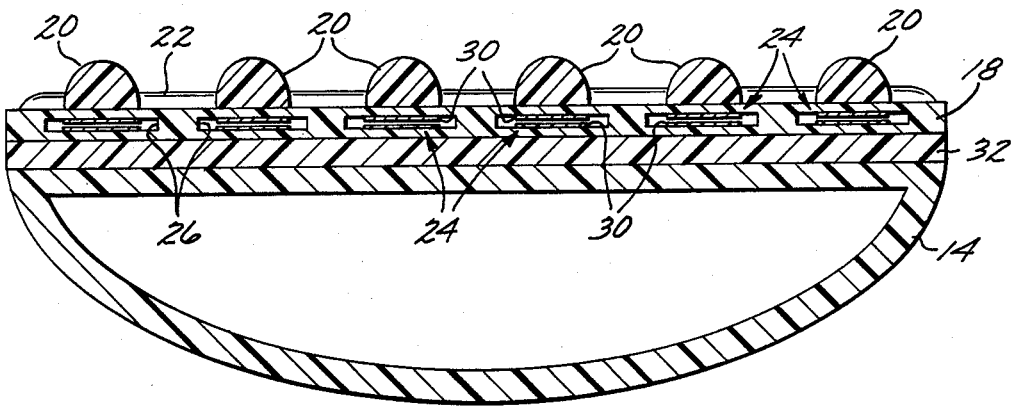
FIG. 3 is a cross-sectional view along line 3—3 of FIG. 2.

The neck 14 has a playing surface or fingerboard 18 (FIG. 2). Extending longitudinally along the fingerboard are six elongate, continuous switch actuation elements or "bars" 20, as best shown in FIGS. 2 and 3. The bars 20, as will be seen, serve as analogs for the strings of a stringed instrument. In the illustrated embodiment, the bars 20 serve as guitar string analogs, and, therefore, the six bars correspond to the six strings of a guitar. Other embodiments may use any number of bars 20, and the number six shown is merely exemplary. The bars 20 are substantially parallel to each other, and they each have a curved exterior surface to approximate the "feel" of strings.

Extending across the fingerboard 18 at spaced intervals is a plurality of interrupted transverse ridges or frets 22, with the interruptions providing gaps for receiving the bars 20.

Figure 4:
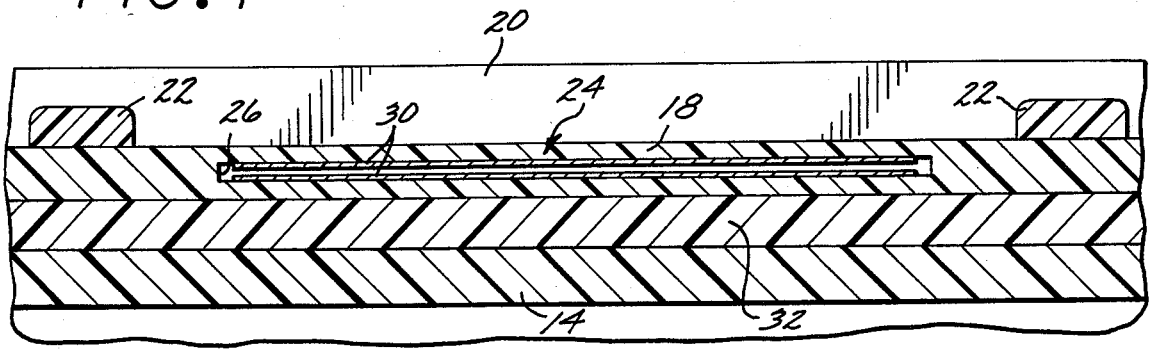
FIG. 4 is a cross-sectional view along line 4—4 of FIG. 2, showing one of the tone-generator actuation switches in the neck in its unactuated (open) position.
Figure 5:
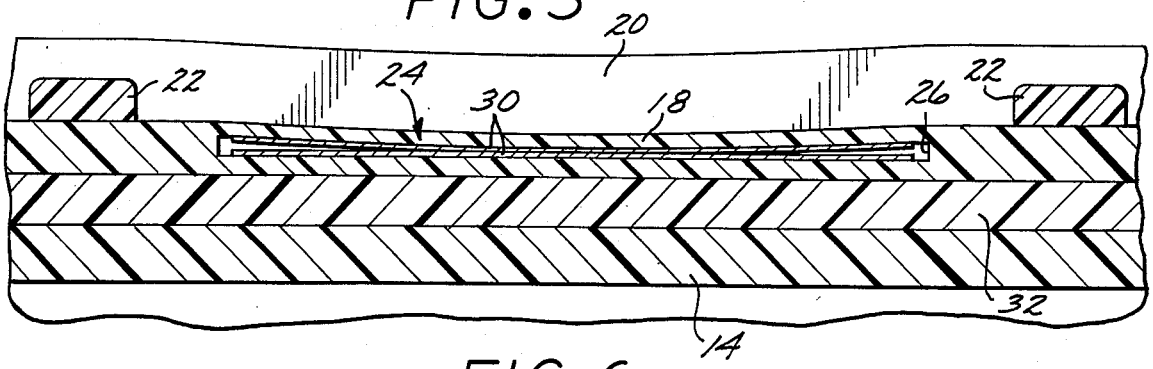
FIG. 5 is a cross-sectional view similar to that of FIG. 4, but showing the switch in its actuated (closed) position.

As best shown in FIGS. 3, 4, and 5, the bars 20 serve as player-actuatable elements for closing a plurality of switches 24 provided in appropriately dimensioned cavities 26 formed within the fingerboard 18, underneath its external playing surface. A grid of the switches 24 is provided, with a row of switches 24 underlying each of the bars 20, one switch 24 in each parallel row spaced between each pair of frets 22. The first switch 24 in each row is situated between the most distal fret 20 (relative to the body 12) and a head 28 which forms the distal end of the neck 14. The last switch 24 in each row is provided between the most proximal fret 20 and the juncture between the neck 14 and body 12.

The switches 24 are, preferably, of the type known as "membrane" switches. Membrane switches are characterized by their very thin cross-sectional dimensions, and their ability to be actuated by relatively light pressures. Each switch comprises a pair of opposed conductive contacts 30, vertically separated by a narrow gap. The contacts 30 are preferably formed on thin planar layers of conductive metal, and the gap between them is maintained by the insulative material from which the fingerboard 18 is formed, which thereby acts as a spacer. As best shown in FIGS. 4 and 5, each contact 30 is elongated along the longer dimension of the neck 14, so as to underlie substantially more than one-half of that portion of the length of its associated bar 20 which extends between a pair of adjacent frets 22. In a specific example of the invention, with frets spaced approximately one inch apart, the contacts 30 are approximately three-quarters of an inch in length. These dimensions are not, however, critical.

The bars 20 are formed on a durable, but flexible, plastic material which allows them to deform somewhat upon the application of pressure. Likewise, the fingerboard material is flexible so that in the thinned areas overlying the switch cavities 26, it can be flexed or deformed. Thus, as shown in FIG. 5, the application of pressure, by means of the player's finger, to a bar 20 causes a localized deformation in the bar 20 and the underlying fingerboard 18. This deformation transmits the pressure to the underlying switch 24, so as to bring into electrical contact its upper and lower contacts 30, thereby forming an electrical path through the switch. The deformation of the bar 20 and fingerboard 18 is sufficiently localized so that only one switch is closed when pressure is applied to a single bar 20 along a part of its length extending between a pair of adjacent frets 22. By having the switch occupy a major proportion of this inter-fret length of the bar, placement of the player's actuating finger can be almost anywhere on this inter-fret length, and still result in the closing of the switch. When the player's finger is lifted, the resilience of the bar and the fingerboard causes them to re-assume their original positions, thereby opening the switch, as shown in FIG. 4.

As briefly mentioned above, the switches 24, when closed, provide electrical paths for the actuation of selected electronic tone-generating mechanisms (such as, for example, voltage controlled oscillators), which are contained in a remote synthesizer unit (not shown). These tone-generating mechanisms can be electrically connected to the switches 24 by printed conductors (not shown) on a circuitboard 32 underlying the fingerboard 18. Alternatively, wires (not shown) can be run through the hollow interior of the neck 14. The conductors or wires are connected to the remote synthesizer unit by a cable 34 (FIG. 1).

Figure 6:
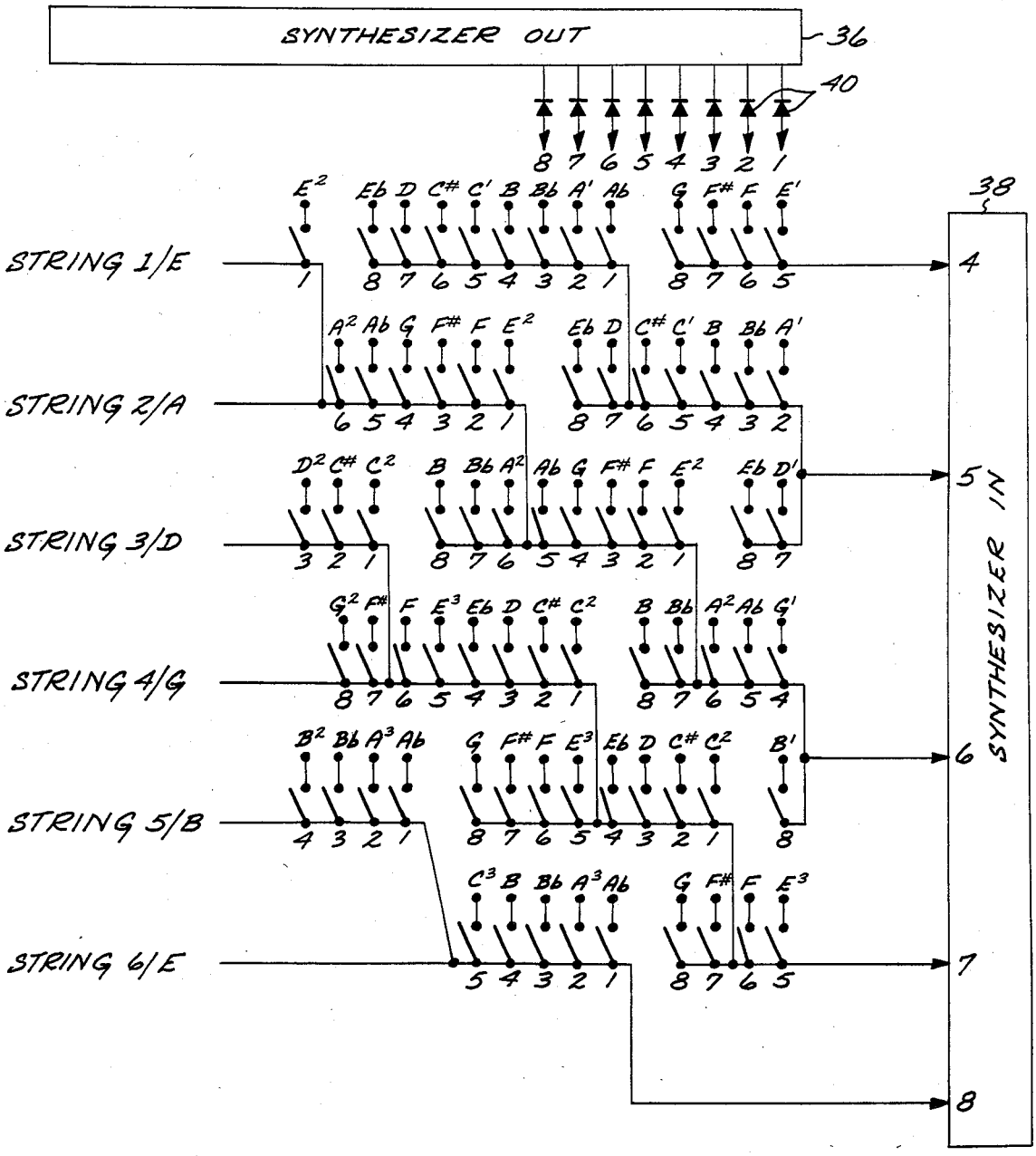
FIGS. 6 and 7 are schematic diagrams of the circuitry incorporating the tone-generator actuation switches.
Figure 7:
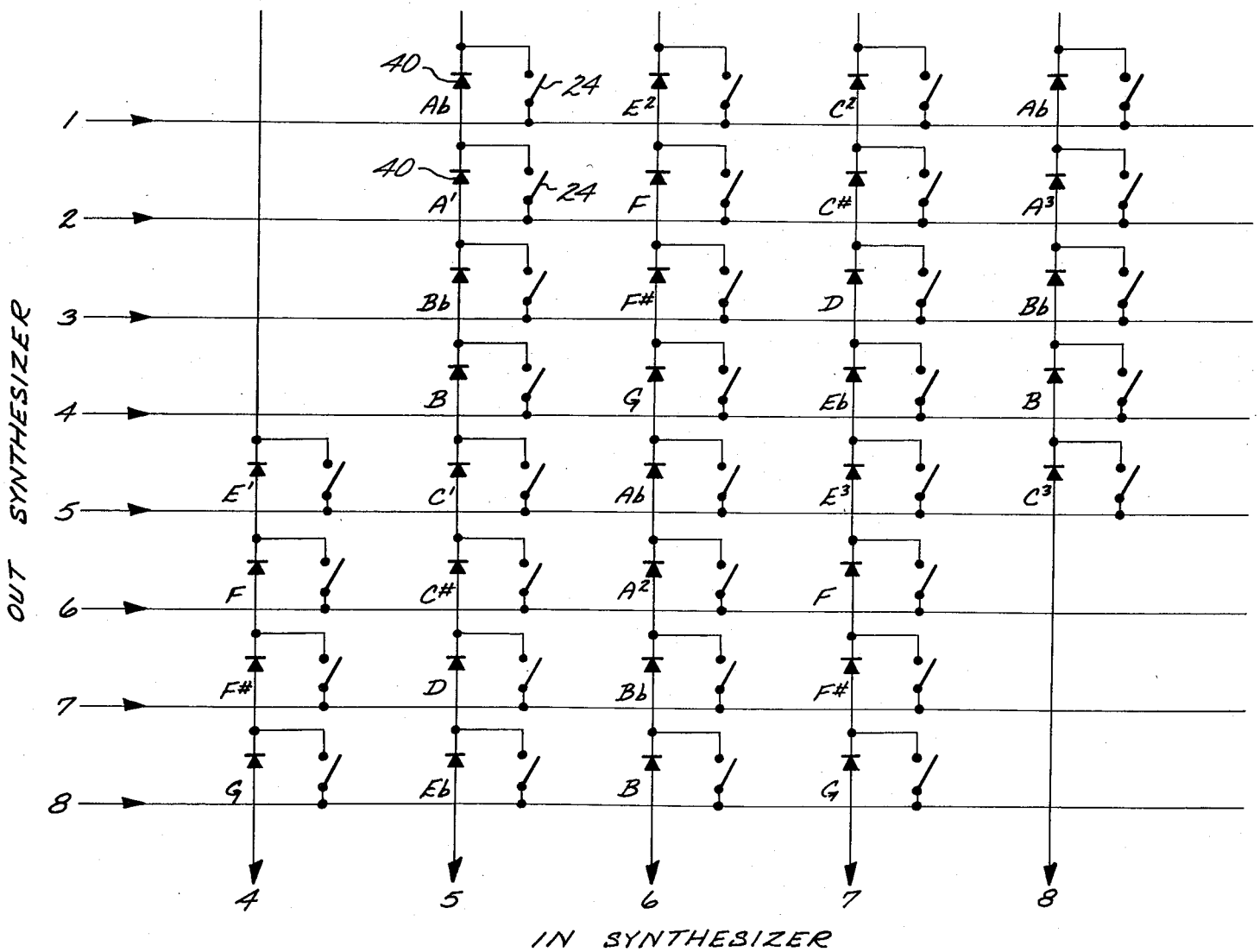

FIGS. 6 and 7 illustrate the electrical circuitry contained in the instrument 10 when the instrument is configured as a guitar analog. It is to be understood that the illustrated circuitry described below is exemplary only; alternative circuit arrangements can be used if the instrument 10 is configured as an analog of other instruments.

Referring first to FIG. 6, an 8-bit synthesizer output buss 36 and an 8-bit synthesizer input buss 38 are shown. The busses 36 and 38 are part of the remote synthesizer unit, and are not part of the subject invention. They are shown for the sake of providing a complete disclosure of the context of the invention. The six bars 20 are identified in FIG. 6 by the names of the strings of a guitar, i.e., string 1 or "E", string 2 or "A", string 3 or "D", string 4 or "G", string 5 or "B", and string 6 or "E". The switches 24 are identified both by the note which is played when the switch is actuated, and by the bit of the output buss 36 to which the switch is electrically connected.

It can be seen from FIG. 6 that each of the switches is connected to one bit of the output buss 36 through a diode 40. Although only eight diodes 40 are shown in FIG. 6, one for each output buss bit, it may be advantageous for each switch to have its own associated diode, as shown in FIG. 7. The diodes 40 may be provided on the circuitboard 32 underlying the switches, and they prevent unwanted feedback through the instrument.

As can be seen from both FIGS. 6 and 7, the first four switches of the first "string", i.e., those corresponding to the notes E', F, F sharp, and G, are connected to bits 5, 6, 7, and 8, respectively, of the output buss 36, and they are all connected to bit 4 of the input buss 38. The switches corresponding to the next eight notes, i.e., A flat through E flat, are connected, respectively, to bits 1 through 8 of the output buss 36, and they are all connected to bit 5 of the input buss 38. From FIG. 6, it can be seen that all of these notes can be played on the first, or "E" string, while some can be played on the second and third, or "A" and "D" strings. Likewise, from FIG. 7, it can be seen that the switches corresponding to the next eight notes, i.e., $E^2$ through B, are connected, respectively, to bits 1 through 8 of the output buss, while all are connected to bit 6 of the input buss. From FIG. 6, it is seen that the note $E^2$ can be played on the first, second, and third strings; the notes F and F sharp on the second and third strings; the notes G, A flat, and $A^2$ on the second, third, and fourth strings; and the notes B flat and B on the third and fourth strings.

Similarly, each of the remaining notes (i.e., $C^2$ through $C^3$) is played by connecting (via a switch 24) a unique pair of input and output bits. As described above, and as shown in FIG. 6, there may be more than one switch which connects a particular pair of input and output bits and thus plays a selected note, and if this is the case, each separate switch which plays a selected note is actuated by a different bar 20. In other words, a particular note may be playable on any one of up to three different "strings", as is the case with a conventional guitar.

As was mentioned previously, the input buss 38 is, preferably, an 8-bit buss. As shown, however, only bits 4 through 8 are connected to the switches 24. Bits 1, 2, and 3 of the input buss 38 may advantageously be reserved for connection to switches (not shown) actuated by the accordian-like keys 16 (FIG. 1). These "key-switches" would then be connected to the synthesizer output through the output buss 36. In this manner, the keys 16 can be employed to provide an extended musical range for the instrument. For example, with the preferred embodiment described above, a player can use one hand to play a melody line, or "lead" on the neck, and the other hand to play a separate "bass" line, on the keys.

From the foregoing, several advantageous features of the invention can be appreciated. Specifically, the configuration of the switch actuation bars 20 as elongate, flexible, continuous elements extending along the instrument's neck provides an excellent analog to the strings of a conventional instrument. This feature is enhanced by the use of the elongate membrane switches 24 between the frets. As a result, the player can play a note by the application of a relatively light finger pressure on a selected bar at the selected location. Moreover, the configurations of the switches and their associated actuation bars allow chord and note changes and progressions to be made without lifting the player's fingers, so that these changes and progressions can be made by simply sliding the fingers up and down the fingerboard, as can be done on a conventional stringed instrument. This feature also lessens the abruptness of the transitions from one note or chord to the next. Thus, the physical "feel" of the instrument is closely analogous to the "feel" of a conventional stringed instrument, so that the playing technique (at least of the hand manipulating the fingerboard switches) does not have to be altered significantly from the conventional technique.

Unlike a conventional stringed instrument, however, the notes are both formed and played on the fingerboard, with one hand, leaving the other hand free to play the keys on the body. As previously discussed, this feature allows an extended musical range for the instrument, as well as greater versatility and complexity in the types of musical tones that can be generated. Thus, as mentioned before, the keys can be used to play a bass accompaniment. Alternatively, they can actuate rhythmic sounds (drumbeats, cymbals) or they can be used to alter the tonal quality of the notes actuated on the fingerboard. Of course, the actual notes, tones, and sounds produced will depend upon the circuitry in the remote synthesizer.

It will be further appreciated, as mentioned above, that while a preferred embodiment of the invention has been shown and described as a guitar analog, the invention may be embodied as an analog to virtually any other stringed instrument. Thus, the number of string-like bars may be varied, as well as their length and the number of switches actuated by the bars. In this manner, the invention can be configured to simulate, for example, a ukelele, a banjo, a violin, a viola, a cello, or even combinations of such instruments. The extent to which the instrument can be made to sound like a particular instrument will, of course, depend upon the electric circuitry in the remote synthesizer unit.

In any event, the preferred embodiment described herein should be considered exemplary only, and the variations alluded to should be considered within the spirit and scope of the invention.

What is claimed is:

1. In an electronic musical instrument, of the type having a body, a neck extending from the body, a fingerboard on said neck, and a player-actuable switching mechanism in said neck for producing selected musical tones through electronic tone-generating means, an improved switching mechanism comprising:

a plurality of separate, pressure-actuable switches arranged in a longitudinal row in said neck underneath the external surface of said fingerboard, each of said switches comprising a discrete pair of opposed conductive contacts; and an elongate, continuous, flexible bar disposed on said fingerboard above said row of switches;

whereby the application of pressure to said bar at a location over a selected one of said switches results in a localized deformation in said bar and the underlying fingerboard, thereby transmitting the pressure to the selected switch, so that said selected switch is actuated by the pressure applied to said bar.

2. The switching mechanism of claim 1, wherein each of said switches is a membrane switch comprising a pair of planar contacts separated by a narrow gap, and wherein each of said switches is located in a cavity within said fingerboard underneath the external surface thereof.

3. The switching mechanism of claim 2, wherein said fingerboard includes a plurality of spaced-apart, transversely-extending frets thereon, each fret having a gap for the passage therethrough of said bar.

4. The switching mechanism of claim 3, wherein the contacts of each of said switches are elongated so as to underlie substantially more than one-half of that portion of said bar which extends between a pair of adjacent frets.

5. The switching mechanism of claim 1, wherein said plurality of switches is a first plurality arranged in a first row and said bar is a first bar, said switching mechanism further comprising:

at least a second plurality of separate, pressure-actuable switches arranged in a second longitudinal row in said neck underneath the external surface of said fingerboard and substantially parallel to said first row; and at least a second elongate, continuous, flexible bar disposed on said fingerboard above said second row of switches.

6. The switching mechanism of claim 1, wherein said bar has a curved exterior surface.

7. The switching mechanism of claim 2, wherein said fingerboard is made of an electrically insulative material.

8. The switching mechanism of claim 1, wherein the deformation of said bar and the underlying fingerboard is sufficiently localized to actuate only a single switch by the transmission of pressure thereto.

9. The switching mechanism of claim 2, wherein said fingerboard is deformable substantially only in the areas overlying said cavities.

10. The switching mechanism of claim 9, wherein said localized deformation closes the gap between the contacts of only the switch in the cavity underlying said localized deformation.

11. In an electronic musical instrument, of the type having a body, a neck extending from the body, a fingerboard on said neck, and a player-actuable switching mechanism in said neck for producing selected musical tones through electronic tone-generating means, an improved switching mechanism, comprising:

a plurality of individual cavities arranged in a longitudinal row in said fingerboard underneath the external surface thereof, said fingerboard being deformable in a flexible area above each of said cavities;

a plurality of separate, pressure-actuable switches, each disposed in one of said cavities, each switch adapted to be separately closed in response to the localized deformation of said fingerboard in one of said flexible areas; and an elongate, continuous, flexible bar disposed on said fingerboard above said row of cavities;

whereby the application of pressure to said bar at a location above a selected one of said cavities results in a localized deformation of said fingerboard in the flexible area above said selected cavity, thereby closing the switch in said selected cavity.

12. The switching mechanism of claim 11, wherein each of said switches is a membrane switch comprising a discrete pair of planar conductive contacts separated by a narrow gap, said gap being closeable in response to said localized deformation.

13. The switching mechanism of claim 11, wherein said fingerboard includes a plurality of spaced-apart, transversely-extending frets thereon, each fret having a gap for the passage of said bar therethrough.

14. The switching mechanism of claim 13, wherein each of said switches comprises a pair of planar conductive contacts, vertically separated by a narrow gap, said gap being closeable in response to said localized deformation, said contacts being elongated-longitudinally so as to underlie substantially more than one-half of that portion of said bar which extends between a pair of adjacent frets.

15. The switching mechanism of claim 11, wherein only the switch in said selected cavity is closed in response to said localized deformation.

16. The switching mechanism of claim 11, wherein said bar has a curved exterior surface.

17. The switching mechanism of claim 11, wherein said fingerboard is made of an electrically insulative material.

18. The switching mechanism of claim 11, further comprising a circuitboard underlying said fingerboard.

19. In an electronic musical instrument of the type having a body and a player-actuable switching mechanism for producing selected musical tones through electronic tone-generating means, an improved switching mechanism, comprising:

a fingerboard of electrically-insulative material attached to said body and having a plurality of individual cavities arranged in a longitudinal row underneath the external surface thereof, said fingerboard being deformable in a flexible area above each of said cavities;

a plurality of separate, pressure-actuable switches, each disposed in one of said cavities, each of said switches being adapted to be separately closed in response to the localized deformation of said fingerboard in one of said flexible areas; and an elongate, continuous, flexible bar disposed on said fingerboard above said row of cavities;

whereby the application of pressure to said bar at a location above a selected one of said cavities results in a localized resilient deformation of said bar and the underlying flexible area, thereby closing the switch in said selected cavity, said deformation being sufficiently localized to close only the switch in said selected cavity.

20. The switching mechanism of claim 19, wherein said fingerboard includes a plurality of spaced-apart, transversely-extending ridges thereon, each of said ridges having means for the passage of said bar therethrough, and wherein each of said switches comprises a pair of planar conductive contacts separated by a narrow vertical gap, said gap being closeable in response to said localized deformation, said contacts being elongated longitudinally so as to underlie substantially more than one-half of that portion of said bar which extends between a pair of adjacent ridges.

* * * * *